US010371174B2

(12) United States Patent
Cho

(10) Patent No.: US 10,371,174 B2
(45) Date of Patent: Aug. 6, 2019

(54) VACUUM PUMP

(71) Applicant: VMECA CO., LTD, Seoul (KR)

(72) Inventor: Ho-Young Cho, Seoul (KR)

(73) Assignee: VMECA CO., LTD, Seoul (KR)

( * ) Notice: Subject to any disclaimer, the term of this patent is extended or adjusted under 35 U.S.C. 154(b) by 327 days.

(21) Appl. No.: 15/125,333

(22) PCT Filed: Apr. 2, 2015

(86) PCT No.: PCT/KR2015/003275
§ 371 (c)(1),
(2) Date: Sep. 12, 2016

(87) PCT Pub. No.: WO2015/156536
PCT Pub. Date: Oct. 15, 2015

(65) Prior Publication Data
US 2017/0067488 A1 Mar. 9, 2017

(30) Foreign Application Priority Data
Apr. 8, 2014 (KR) ..... 10-2014-0041677

(51) Int. Cl.
*F04F 5/14* (2006.01)
*F04F 5/22* (2006.01)
(Continued)

(52) U.S. Cl.
CPC ..... *F04F 5/22* (2013.01); *F04F 5/14* (2013.01); *F04F 5/16* (2013.01); *F04F 5/46* (2013.01)

(58) Field of Classification Search
CPC ..... F04F 5/14; F04F 5/16; F04F 5/22; F04F 5/46; F04F 5/461
See application file for complete search history.

(56) References Cited

U.S. PATENT DOCUMENTS 3,061,179 A * 10/1962 Pendleton ..... F04F 5/22 417/176
3,239,131 A * 3/1966 Whyte ..... F04F 5/54 417/202
(Continued)

FOREIGN PATENT DOCUMENTS

KR 200274370 4/2002
KR 100629994 B1 10/2006
(Continued)

OTHER PUBLICATIONS

International Search Report & Written Opinion dated Apr. 20, 2015, from corresponding International PCT Patent Application No. PCT/KR2015/003275, 8 pages.

*Primary Examiner* — Patrick Hamo
(74) *Attorney, Agent, or Firm* — Innovation Capital Law Group, LLP; Vic Lin

(57) ABSTRACT

The present invention relates to a vacuum pump and, more specifically, to a vacuum pump that is designed to change the direction of an intake port formed on a side wall of a housing, according to necessity. The vacuum pump includes: a housing; an ejector part embedded in the housing; and a pressing means provided on the outside of the housing. Particularly, the housing includes two or more parts, including a main part that has the intake port, which are disposed in a line, wherein a stopping member is formed along a contact surface there between. This structure enables the main part to rotate, and thus the direction of the intake port can be changed.

20 Claims, 9 Drawing Sheets

(51) Int. Cl.
*F04F 5/16* (2006.01)
*F04F 5/46* (2006.01)

(56) References Cited

U.S. PATENT DOCUMENTS 3,282,227 A * 11/1966 Nielsen ..... F04F 5/461 239/318
3,575,532 A * 4/1971 Mugele ..... F04C 19/005 417/69
4,395,202 A 7/1983 Tell
4,466,778 A 8/1984 Volkmann
4,505,645 A * 3/1985 Laguilharre ..... F04B 23/12 417/69
4,759,691 A 7/1988 Kroupa
4,790,054 A 12/1988 Nichols
4,861,232 A * 8/1989 Ise ..... F04F 5/20 417/76
4,880,358 A 11/1989 Lasto
5,169,293 A 12/1992 Yamamoto
5,228,839 A * 7/1993 Peterson ..... F04F 5/22 417/174
5,683,227 A 11/1997 Nagai et al.
6,394,760 B1 5/2002 Tell
6,582,199 B1 6/2003 Volkmann
6,585,695 B1 7/2003 Adair et al.
7,438,535 B2 10/2008 Morishima
8,231,358 B2 7/2012 Cho
9,175,688 B2 * 11/2015 Neel ..... F04C 23/005

FOREIGN PATENT DOCUMENTS

KR 101029967 B1 4/2011
KR 101039470 B1 6/2011
KR 101066212 B1 9/2011
KR 101195984 B1 10/2012
KR 1020130026859 A 3/2013
KR 101351768 B1 8/2014

* cited by examiner

Prior Art

VACUUM PUMP

TECHNICAL FIELD

The present invention relates generally to a vacuum pump for use in a vacuum transfer system. More particularly, the present invention relates to a vacuum pump designed to change the direction of an intake port formed on a side wall of a housing according to necessity.

BACKGROUND ART

A vacuum transfer system refers to a system where a vacuum pump is operated by means of high-speed compressed air so as to exhaust air from an inner space of a suction cup or a suction pad, and an object is gripped and transferred to a predetermined place using negative pressure while exhausting the air. The present invention relates particularly to a vacuum pump constituting the vacuum transfer system.

Referring to FIGS. 1 and 2, a conventional vacuum pump 1 includes: a hollow housing 2 provided with an inlet port 3 at a first end and an exhaust port 4 at a second end, and provided with an intake port 5 therebetween; and a multiple-step ejector 6 mounted inside the housing 2 in series. The vacuum transfer system is configured such that the vacuum pump 1 is locked to equipment using a means, such as a bracket, supporting the housing 2, and the vacuum pump, along with a suction cup 7 communicating with the ejector 6 by being connected to the intake port 5 and a robot arm connected to the suction cup 7.

The compressed air is supplied to the inlet port 3, passes through the ejector 6 at a high speed, and then is discharged through the exhaust port 4 to the outside. Here, the air inside the suction cup 7 is induced inside the ejector 6, and is discharged along with the compressed air. In the exhaust process described above, vacuum and negative pressure are generated in the inner space of the suction cup 7, and the vacuum transfer system grips and transfers an object to a predetermined place by using the negative pressure.

The vacuum pump 1 shown in the drawings is disclosed by Korean Utility Model Registration No. 274370, but is not different from a vacuum pump disclosed by Korean Patent No. 1029967, No. 1039470, No. 1066212, and No. 1351768 in terms of basic configuration and operation. Meanwhile, the vacuum pump 1 is utilized for constituting the vacuum transfer system on site, but the vacuum pump has following problems.

Firstly, it is impossible to change a direction of each port. For example, in the state where the vacuum pump 1 is mounted and locked to the equipment, it is generally not required to change the direction of the inlet port 3 and the exhaust port 4. However, the direction of the intake port 5 is often required to be changed according to a place of an object and a transfer location. The conventional vacuum pump 1 may not effectively respond to the necessity of changing direction.

Secondly, it is impossible to change a full length of the housing 2. For example, as in the vacuum pump disclosed by Korean Patent No. 1351768, in the case where one cylindrical ejector is mounted inside the housing, it is required to adjust a full length of the housing 2 according to a cartridge to be applied. However, the conventional vacuum pump 1 may not structurally respond to the necessity of adjusting the length.

Thirdly, in order to manufacture the conventional vacuum pump 1, a complex mounting arrangement is required. The complexity is shown throughout installation of the ejector 6 and assembly of the housing 2, and thereby assembling/disassembling of the vacuum pump 1 are difficult and productivity is lowered.

DISCLOSURE

Technical Problem

Accordingly, the present invention has been made keeping in mind the above problems occurring in the related art, and the present invention is intended to propose a vacuum pump designed to change direction of ports, more particularly, a direction of an intake port according to necessity. The present invention is further intended to propose a vacuum pump configured such that elements constituting the vacuum pump are assembled/disassembled easily.

Technical Solution

In order to achieve the above object, according to one aspect of the present invention, there is provided a vacuum pump including: a housing provided by linearly arranging at least two parts including a hollow main part having a compressed air inlet port, an exhaust port, an intake port, and a vacuum chamber communicating with the intake port respectively provided at a first end, at a second end, on a side wall of the main part, and in the main part, wherein between the main part and adjacent parts, a plurality of stopping members is provided along contact surfaces, whereby the main part is rotated relative to the adjacent parts, and accordingly a direction of the intake port is changed; an ejector part including a cylindrical ejector main body mounted inside the housing, the ejector main body including: an inlet provided at a first end thereof and communicating with the inlet port; an outlet provided at a second end thereof and communicating with the exhaust port; and a through-hole provided on a side wall thereof and communicating with the intake port via the vacuum chamber; and means for providing adhesion between the parts.

The stopping members may have a correspondent structure of protrusion-groove or rotatable saw-tooth.

The ejector part may further include a first support body and a second support body that are respectively mounted to opposite ends of the ejector main body and are configured such that external circumferences thereof come into contact with an internal circumference of the housing, wherein the first and second support bodies are designed not to interfere with communication between each of the ports and the ejector main body.

Preferably, the vacuum pump of the present invention further includes: pressing means provided on opposite sides of the housing so as to provide adhesion between the parts. To be more specific, the pressing means may include: a plate coming into contact with each of side surfaces of the housing; and a pressing ring pressing the plate and the parts to be close to each other by being inserted into an end of the ejector part having passed through a mount hole of the plate.

Preferably, the plate is a bracket for locking the vacuum pump.

Advantageous Effects

According to a vacuum pump of the present invention having the above-described characteristics, the housing is provided by linearly arranging at least two parts, wherein the main part is rotatable relative to the adjacent parts. Accordingly, the vacuum pump of the present invention is advantageous in that: the a direction of the intake port can be changed when necessary; the housing and elements constituting the vacuum pump are connected to each other by insertion or setting, whereby without an additional tools, it is easy to assemble/disassemble the vacuum pump; and depending on design, it is possible to select a size of the housing according to a size of the ejector part embedded in the housing.

BEST MODE

Figure 1:
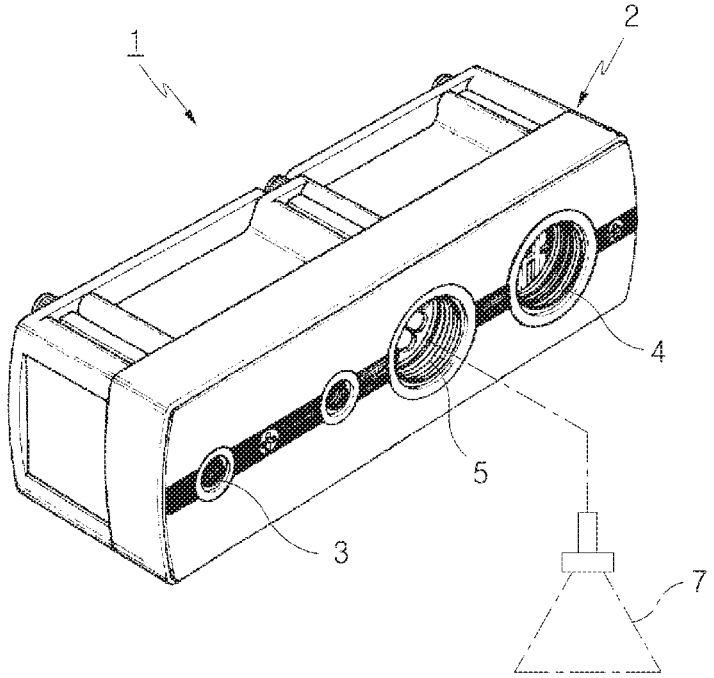
FIG. 1 Prior Art
FIG. 1 is an outside view of a conventional vacuum pump.
Figure 2:
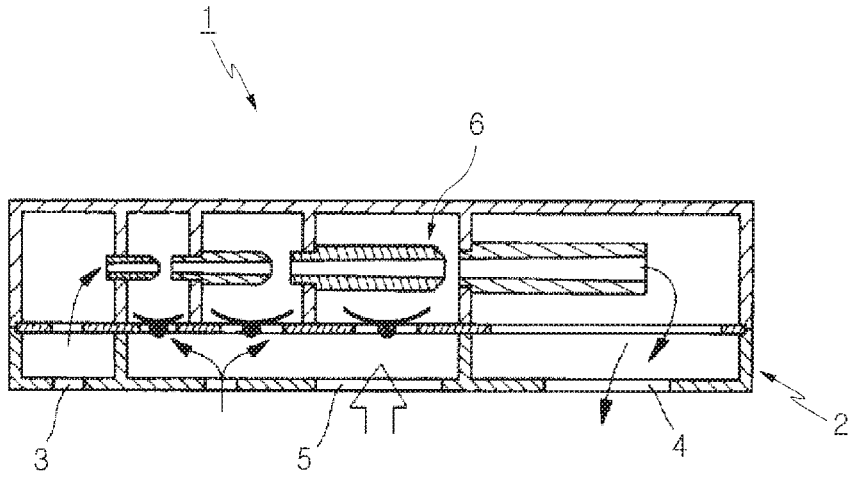
FIG. 2 is a sectional view of FIG. 1.
Figure 3:
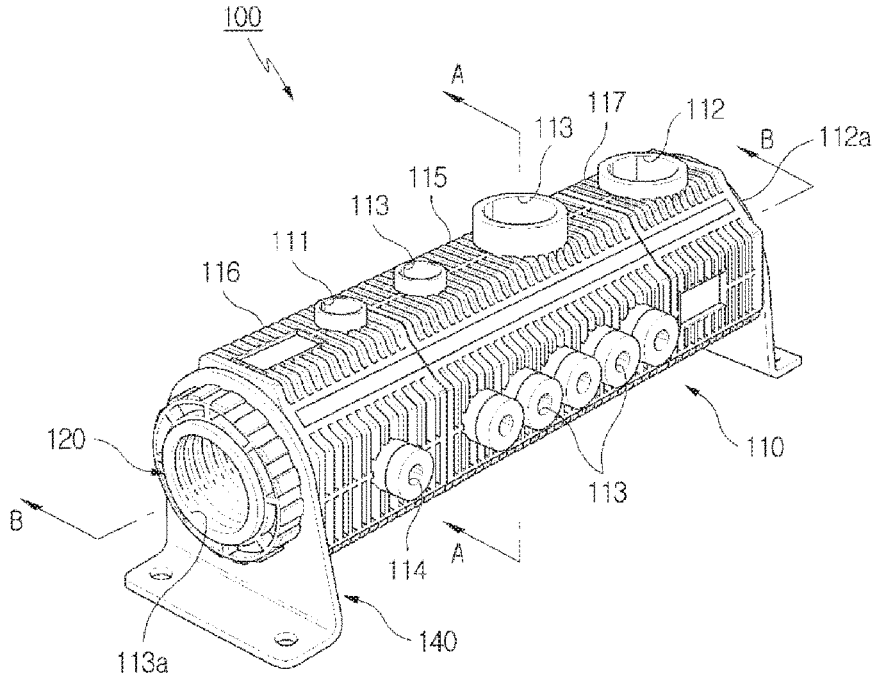
FIG. 3 is an outside view of a vacuum pump according to the present invention.
Figure 4:
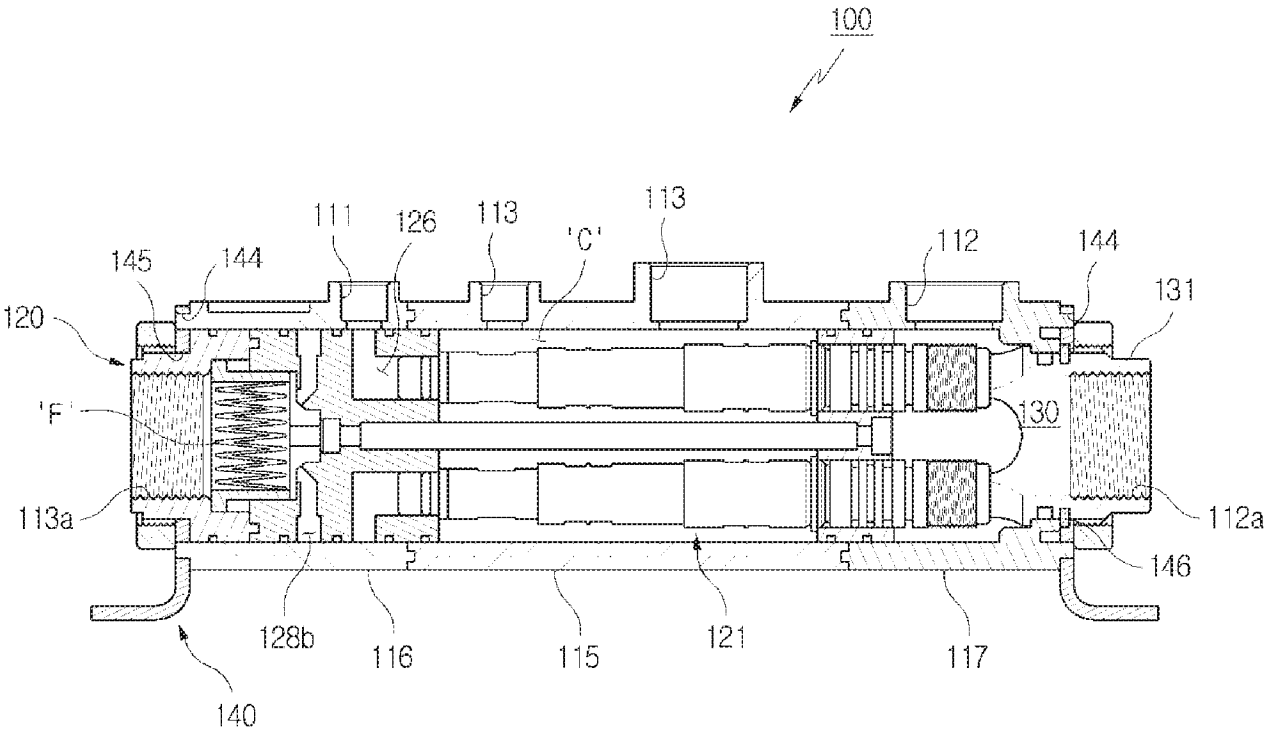
FIG. 4 is a sectional view taken along line A-A of FIG. 3.
Figure 5:
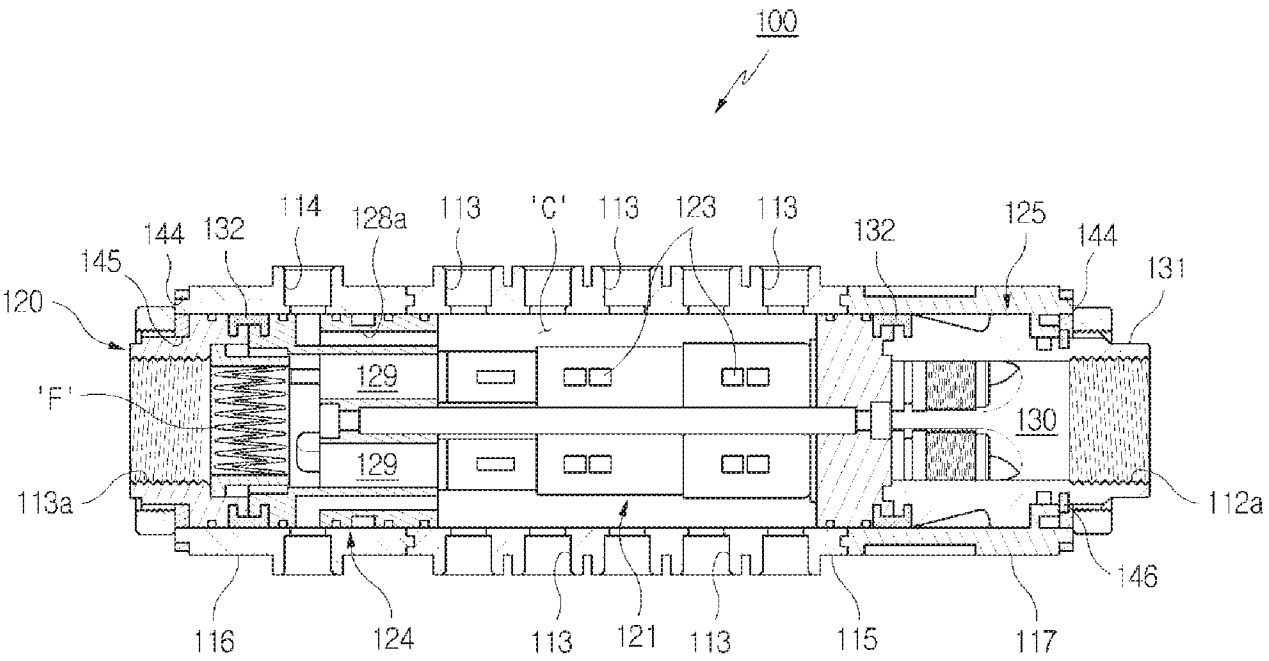
FIG. 5 is a sectional view taken along line B-B of FIG. 3.
Figure 6:
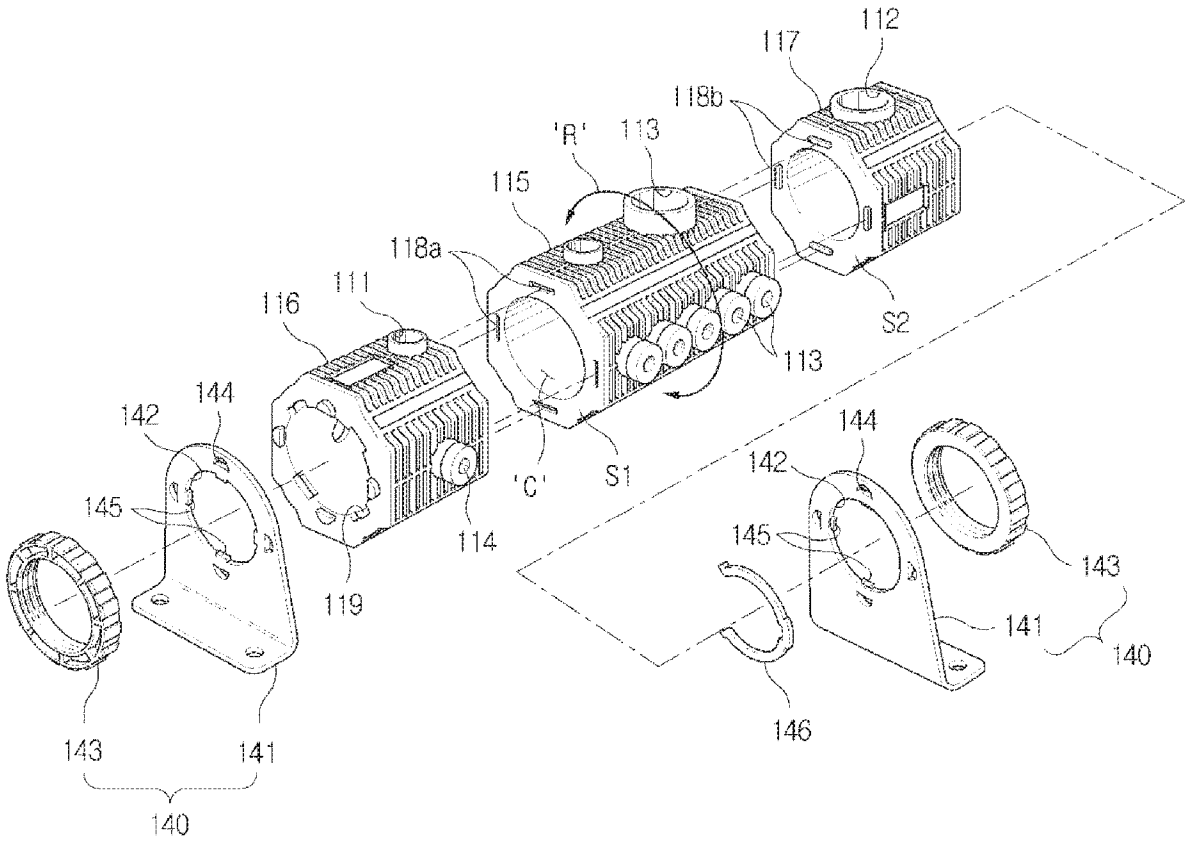
FIG. 6 is an exploded sectional view illustrating a housing of FIG. 3.
Figure 7:
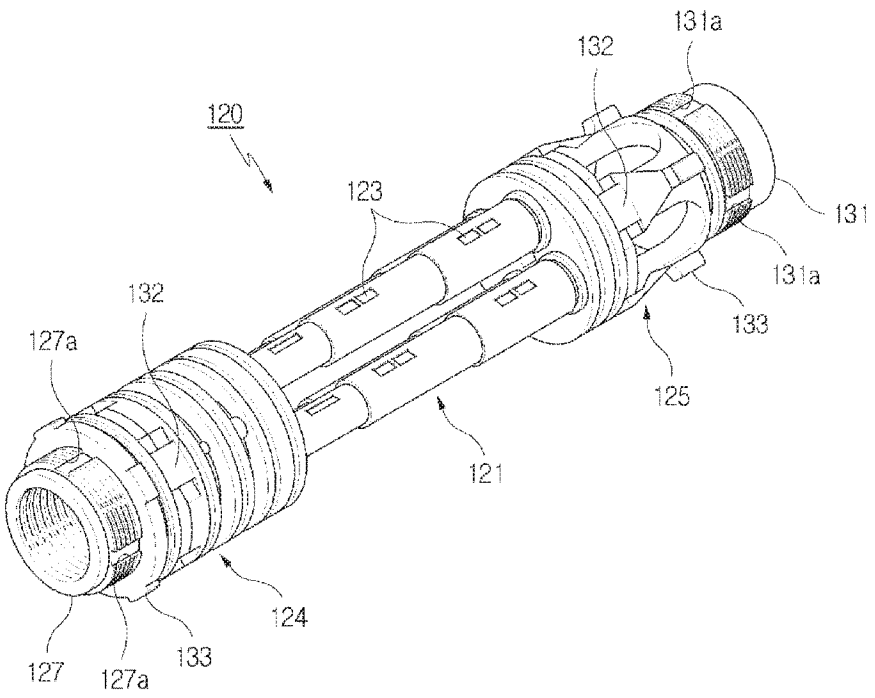
FIG. 7 is a sectional view illustrating an ejector part of FIG. 4.
Figure 8:
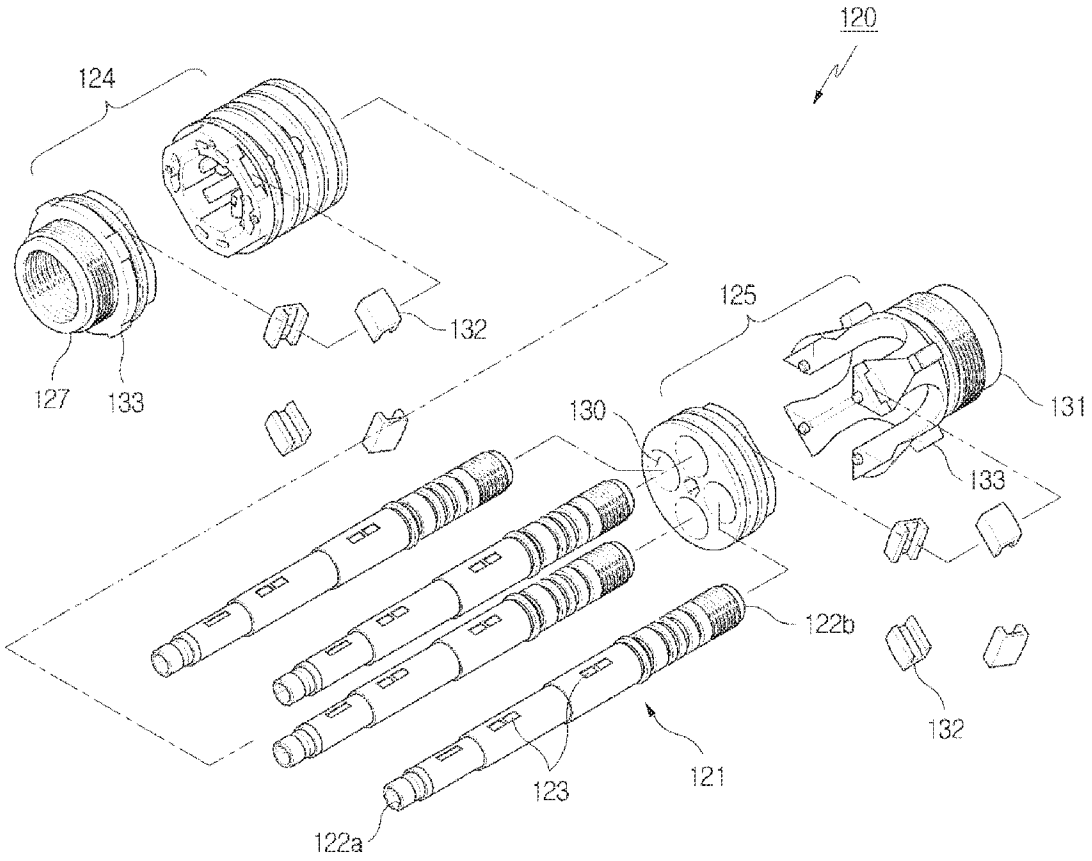
FIG. 8 is an exploded sectional view of FIG. 7.
Figure 9:
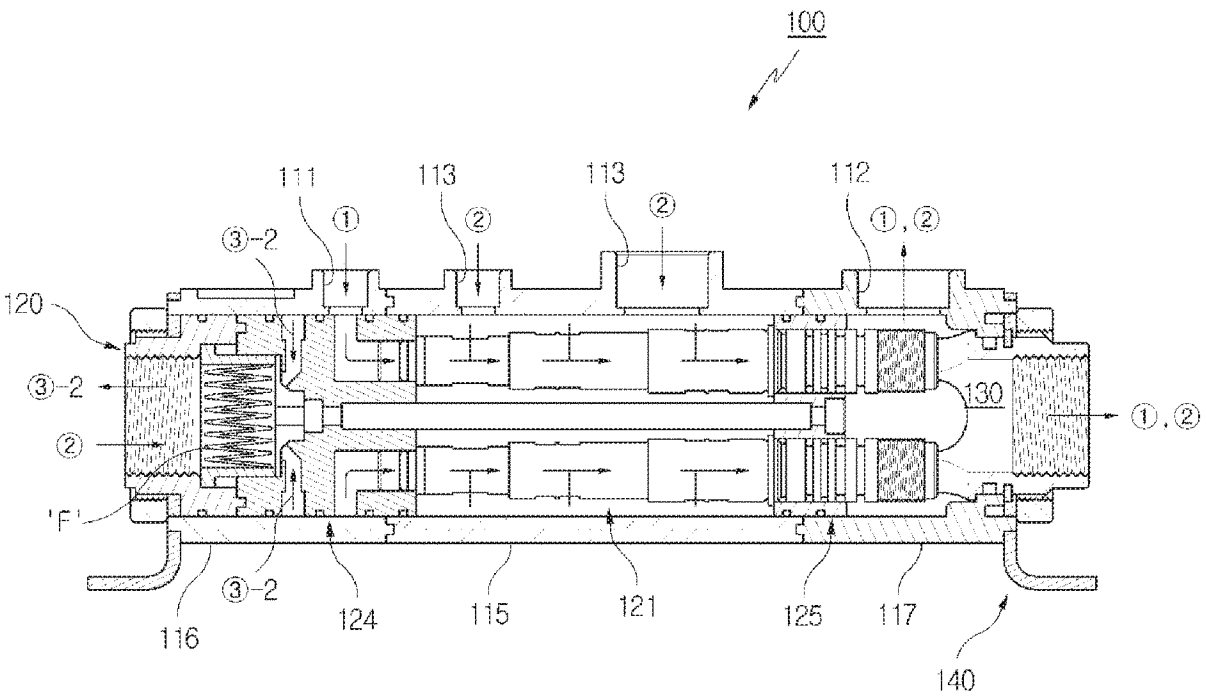
FIGS. 9 and 10 are views based on FIGS. 4 and 5, and illustrating an operation of the vacuum pump according to the present invention.
Figure 10:
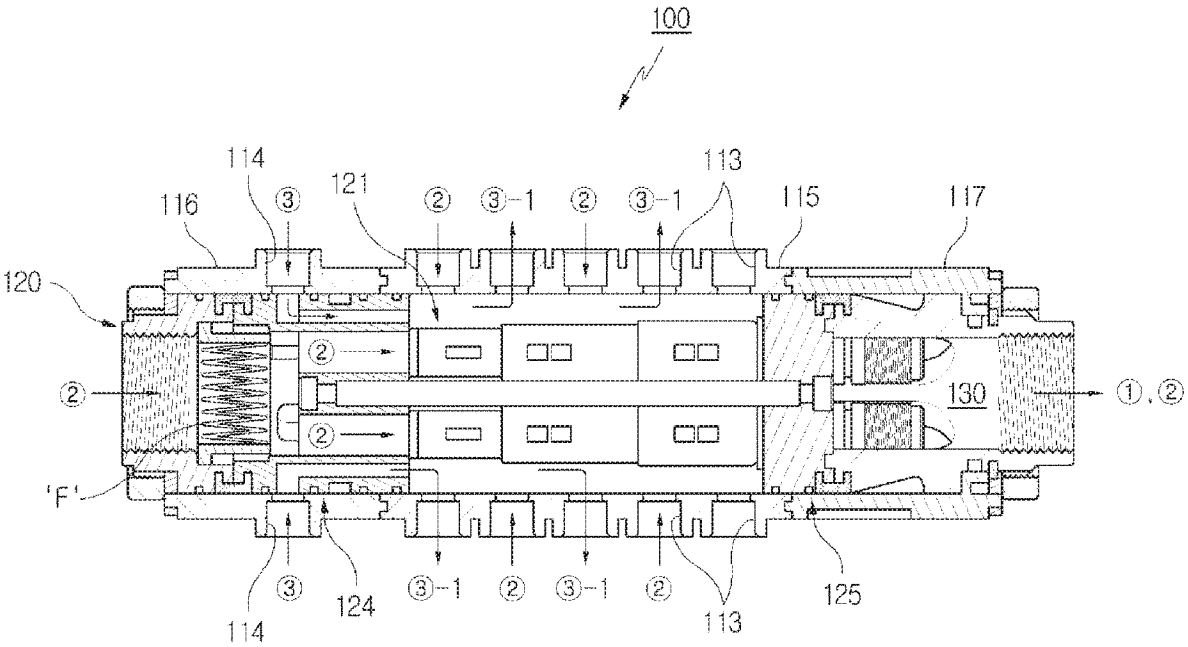

Detailed features and advantages of a vacuum pump capable of changing direction (hereinafter, denoted as a vacuum pump) of the present invention will be apparent from the following detailed description based on the accompanying drawings. The vacuum pump according to the present invention is designated by reference numeral 100 in FIGS. 3 to 10.

Referring to FIGS. 3 to 8, the vacuum pump 100 according to the present invention includes: a hollow housing 110; an ejector part 120 embedded in the housing 110; and a pressing means 140 provided on an outside of the housing 110.

The housing 110 is a hollow member provided with a compressed air inlet port 111, an exhaust port 112, and an intake port 113 respectively at a first end, a second end, and on a side wall thereof, and is formed with a vacuum chamber C therein that communicates with the intake port 113. Preferably, the housing further includes a vacuum-break port 114 communicating with the vacuum chamber C. In the present invention, at least two cylindrical parts 115, 116, and 117 including a main part 115 having the intake port 113 are arranged in a line to form the housing 110.

In an embodiment of the present invention, three parts 115, 116, and 117, which include the main part 115 disposed in the middle and adjacent parts 116 and 117 disposed respectively at opposite side of the main part, form the one housing 110. Of course, in another embodiment, at least two or four parts may form the housing 110, and by being provided with short parts, the length of the housing 110 may be adjusted according to necessity, for example, according to a length of the ejector part 120 to be embedded therein.

Further, in the embodiment of the present invention, the inlet port 111 is provided in a first adjacent part 116, the intake port 113 is provided in the main part 115, and the exhaust port 112 is provided in a second adjacent part 117. Further, the intake port 113 is provided on each surface of the main part 115 in various shapes and in plural. Herein, each location of the ports 111, 112, and 113 is not limited to the respective parts 115, 116, and 117 described above. Further, each of the parts 115, 116, and 117 may have at least two kinds of ports 111, 112, and 113.

In the drawings, reference numerals 113*a* and 112*a* respectively designate an intake port and an exhaust port respectively provided at opposite ends of the ejector part 120.

Between the main part 115 and the adjacent parts 116 and 117, a plurality of stopping members 118*a* and 118*b* is provided along contact surfaces S1 and S2. In the drawings, a correspondent structure of protrusion-groove is shown as an example of the stopping members 118*a* and 118*b*, but is not limited thereto. The stopping members may have a correspondent structure of rotatable saw-tooth, and various modifications are possible when necessary.

The number and locations of the stopping members 118*a* and 118*b* have to do with an outer shape of the main part 115. As shown in the drawings, when the main part is in a quadrangular shape, four stopping members 118*a* and 118*b* are provided on respective surfaces to correspond to each other, and have the same shape as each other. Thereby, the main part 115 is capable of being connected to the adjacent parts 116 and 117 in one selected direction while rotating relative to the adjacent parts 116 and 117 (see R of FIG. 6), and in the embodiment of the present invention, a direction of the intake port 113 can be selected among four different directions according to necessity.

In reality, in the vacuum transfer system, the housing 110 may be connected to a plurality of flexible hoses for connecting each intake port 113 and the suction cup. Here, according to directions of the intake port 113, a vacuum cup, or an object, the hose may be twisted or tangled. In the case of twisting or tangling, the intake port 113 is advantageous in that the direction thereof can be changed according to necessity.

The ejector part 120 includes: an ejector main body 121 mounted inside the housing 110, particularly, mounted to the vacuum chamber C in a longitudinal direction thereof; and support bodies 124 and 125 supporting opposite ends of the ejector main body 121 inside the housing 110. Herein, the main body 121 is a cylindrical ejector including: an inlet 122*a* provided at a first end thereof and communicating with the compressed air inlet port 111 of the housing 110; an outlet 122*b* provided at a second end thereof and communicating with the exhaust port 112; and through-hole 123 provided on a side wall thereof and communicating with the intake port 113 via the vacuum chamber.

The ejector main body 121 configured as described above has high mount ability, and thereby the ejector main body can be designed to be mounted inside the housing 110 without additional support means. In the embodiment of the present invention, however, the ejector part 120 further includes a first support body 124 and a second support body 125 that are respectively mounted to opposite ends of the ejector main body 121 and are configured such that external circumferences thereof come into contact with an internal circumference of the housing 110 so as to allow the vacuum chamber C to be formed inside the housing 110 and to give the ejector main body 121 stability. Here, it is preferred that the first and second support bodies 124 and 125 are designed not to interfere with communication between each of the ports 111, 112, 112*a*, 113, 113*a*, and 114 and the ejector main body 121.

The first support body 124 includes: a supply line 126 extending to the inlet port 111, with an end of the inlet 122*a* of the ejector main body 121 being inserted thereinto; and an annular protruding portion 127 facing outside the housing 110. Preferably, the first support body 124 further includes a vacuum-break line 128*a* extending from the vacuum-break port 114 provided in the housing 110 to the vacuum chamber C.

In the embodiment of the present invention, the protruding portion 127 is configured such that an internal circumference thereof is used as the intake port 113*a*. To achieve this, the first support body 124 includes a path 129 extending from the intake port 113*a* to the vacuum chamber C, and further includes a vacuum-break line 128*b* extending from the vacuum-break port 114 to the intake port 113*a*, namely, to the internal circumference of the protruding portion 127. As shown in the drawings, the intake port 113*a* of the protruding portion 127 is provided with a filter F for filtering intake air. Here, the vacuum-break line 128*b* is formed to be inclined relative to a rear surface of the filter F, wherein the incline does not attenuate velocity and pressure of the compressed air supplied to the vacuum-break port 114.

The second support body 125 includes: an exhaust line 130 extending to the exhaust port 112, with an end of the outlet 122*b* of the ejector main body 121 being inserted thereinto; and an annular protruding portion 131 facing outside the housing 110. In the embodiment of the present invention, the protruding portion 131 of the second support body 125 is configured such that an internal circumference thereof is used as the exhaust port 112*a*.

In the drawings, each of the first support body 124 and the second support body 125 is divided into an inner body directly supporting the ejector main body 121 and the protruding portion 127, 131, and the inner body and the protruding portion are coupled with each other by using U-shaped clips 132 provided on outer surfaces of the bodies. Accordingly, elements constituting the ejector main body 121 and the support bodies 124 and 125 can be assembled easily. Of course, the configuration may be one body or may be modified into other shapes according to design. Reference numeral 133 designates a stopping member formed in the support bodies 124 and 125, wherein the stopping member is formed in each of the first support body 124 and the second support body 125 to prevent the ejector part 120 from undesirably rotating, and corresponds to a key groove 119 formed in each of the adjacent parts 116 and 117 disposed at opposite sides of the housing 110.

The vacuum pump 100 of the present invention includes means for providing adhesion between the parts 115, 116, and 117 of the housing 110. The stopping members 118*a* and 118*b* may be used as the means for providing adhesion by proper modification, and accordingly, in this case, an additional configuration for the means may not be required. In the embodiment of the present invention, the means for providing adhesion are as follows: a snap ring 146 fitted over the external circumference of the protruding portion 131 of the ejector part 120 protruding to an end of the housing 110; and a pressing means 140 provided at at least one of opposite sides of the housing 110. Hereinbelow, reference will be made in detail to the pressing means 140 of the means for providing adhesion.

The pressing means 140 is provided at at least one of opposite sides of the housing 110 and provides adhesion between neighboring parts 115, 116, and 117. To be more specific, the pressing means includes: a plate 141 coming into contact with each of side surfaces of the housing 110; and a pressing ring 143 pressing the plate 141 and the parts 115, 116, and 117 to be close to each other by being inserted into an end of the ejector part 120 passing through a mount hole 142 of the plate 141.

Reference numeral 144 designates insertion holes or grooves formed on a surface of the plate 141 to firmly lock the housing 110 by corresponding to side protrusions of the adjacent parts 116 and 117. The holes 144 are formed in plural along a periphery of the mount hole 142, and thereby the adjacent parts 116 and 117 are rotatable relative to the plate 141 to change directions thereof. This structure enables that directions of the intake port 111 and the exhaust port 112 of the housing 110 can be changed.

Reference numeral 145 designates inner protrusions of the mount hole 142 to prevent the ejector part 120 from undesirably rotating by corresponding to stop grooves 127*a* and 131*a* formed on an external circumferential surface of the protruding portion 131 of the ejector part 120. Preferably, the plate 141 may be used as a bracket for locking the vacuum pump 100, and the pressing ring 143 is a nut fitted over the external circumference of each of the protruding portions 127 and 131.

The vacuum pump 100 of the present invention configured as described above constitutes a vacuum transfer system in cooperation with a compressed air supply device selectively connected to the inlet port 111 and the vacuum-break port 114 via a solenoid valve, a suction cup connected to each intake port 113 using a long hose, a robot arm connected to the suction cup, and the like. Further, the vacuum pump 100 serves to generate or break vacuum and negative pressure in response to a supply direction of the compressed air.

Hereinbelow, reference will be made to a performance process of generating or breaking vacuum and negative pressure with reference to FIGS. 4, 5, 9, and 10.

Firstly, the compressed air is supplied to the inlet port 111, then passes through the supply line 126 and the exhaust line 130 at a high speed, and is discharged to the outside through the exhaust ports 112 and 112*a* (see arrow ①). Here, the air inside the vacuum cup sequentially passes through the intake ports 113 and 113*a*, the vacuum chamber C and the through-holes 123, then is induced into the ejector main body 121, and is discharged to the outside through the exhaust ports 112 and 112*a* along with the compressed air (see arrow ②).

In the above process, vacuum and negative pressure are generated in the vacuum chamber C and the suction cup, and it is possible to grip an object using the generated negative pressure. Further, the robot arm is operated to transfer the object to a predetermined location. Here, depending on locations of the intake port 113, the vacuum cup, the object, or the like, hoses connecting the intake port 113 and the suction cup may be bent, folded, or tangled. In this case, by slightly loosening the pressing ring 143, it is possible to select the direction of the intake port 113 while rotating the main part 115. According to a correspondent type of the stopping members 118*a* and 118*b*, without loosening the pressing ring 143, it is possible to select the direction of the intake port 113 by forcibly rotating the main part 115.

Next, after the object is transferred, in order to quickly separate the suction cup from the object, the compressed air is supplied to the vacuum-break port 114. The compressed air (see arrow ③) supplied to the vacuum-break port 114 passes through the vacuum-break lines 128*a* and 128*b*, and then is supplied to the intake ports 113 and 113*a* via the vacuum chamber C or directly thereto (see arrows ③-1 and ③-2). Thereby, the generated vacuum and negative pressure are broken, and the vacuum cup is separated from the object.

In particular, the compressed air having passed through the vacuum-break line 128*b* serves to remove foreign substances on the rear surface of the filter F by bumping against the rear surface of the filter while passing therethrough.

[Description of reference characters of important parts]

| | |
|---|---|
| 111: inlet port | 112, 112a: exhaust port |
| 113, 113a: intake port | 114: vacuum-break port |
| 115: main part | 116, 117: adjacent part |
| 118a, 118b: stopping member | 119: key groove |
| 120: ejector part | 121: main body |
| 122a: inlet | 122b: outlet |
| 123: through-hole | 124, 125: support body |
| 126: supply line | 127: protruding portion |
| 128a, 128b: vacuum-break line | 129: path |
| 130: exhaust line | 131: protruding portion |
| 132: clips | 133: stopping member |
| 140: pressing means | 141: plate |
| 142: mount hole | 143: pressing ring |
| 144: holes | 145: protrusions |
| 146: snap ring | C: vacuum chamber |
| F: filter | S1, S2: contact surface |

The invention claimed is:

1. A vacuum pump comprising:

a housing provided with a compressed air inlet port, an exhaust port, and an intake port at a first end, at a second end, and on a side wall of the housing, respectively, with a vacuum chamber being formed in the housing and communicating with the intake port, the housing being configured such that at least two parts, including a main part provided with the intake port, and at least one adjacent part, are linearly arranged, wherein between the main part and the at least one adjacent part, a plurality of stopping members is provided along contact surfaces, whereby the main part is rotated relative to the at least one adjacent part, and accordingly a direction of the intake port is changed;

an ejector part including a cylindrical ejector main body mounted inside the housing, the ejector main body including: an inlet provided at a first end thereof and communicating with the inlet port; an outlet provided at a second end thereof and communicating with the exhaust port; and a through-hole provided on a side wall thereof and communicating with the intake port via the vacuum chamber; and means for providing adhesion between the main part and the at least one adjacent part, wherein the ejector part further includes a first support body and a second support body that are respectively mounted to opposite ends of the ejector main body and are configured such that external circumferences thereof come into contact with an internal circumference of the housing, wherein the first and second support bodies are designed not to interfere with communication between each of the ports and the ejector main body.

2. The vacuum pump of claim 1, wherein the stopping members have a correspondent structure of protrusion-groove or rotatable saw-tooth.

3. The vacuum pump of claim 1, wherein the housing further includes a vacuum-break port communicating with the vacuum chamber.

4. The vacuum pump of claim 1, wherein the first support body includes a supply line extending to the inlet port, with an end of the inlet of the ejector main body being inserted into the supply line; and a vacuum-break line extending from a vacuum-break port provided in the housing to the vacuum chamber.

5. The vacuum pump of claim 1, wherein the second support body includes an exhaust line extending to the exhaust port, with an end of the outlet of the ejector main body being inserted thereinto.

6. The vacuum pump of claim 1, wherein the first support body or the second support body is configured to be divided into an inner body directly supporting the ejector main body and a protruding portion, the inner body and the protruding portion being coupled with each other by using U-shaped clips provided on outer surfaces thereof.

7. The vacuum pump of claim 1, further comprising: pressing means, as the means for providing adhesion, provided at least one of opposite sides of the housing so as to provide adhesion between the parts.

8. The vacuum pump of claim 7, wherein the pressing means is a snap ring fitted over an external circumference of an outer protruding portion of the ejector part, the outer protruding portion protruding to an end of the housing.

9. The vacuum pump of claim 7, wherein the pressing means includes: a plate coming into contact with each of side surfaces of the housing; and a pressing ring pressing the plate and the parts to be closed to each other by being inserted into an end of the ejector part or into a protruding portion having passed through a mount hole of the plate.

10. The vacuum pump of claim 9, wherein the plate is a bracket for locking the vacuum pump.

11. The vacuum pump of claim 9, wherein, to firmly lock the housing, the plate corresponds to sides of the at least one adjacent part by holes and protrusions.

12. The vacuum pump of claim 11, wherein the holes are formed in plural along a periphery of the mount hole such that the at least one adjacent part are rotatable relative to the plate to change directions thereof.

13. A vacuum pump comprising:

a housing provided with a compressed air inlet port, an exhaust port, and an intake port at a first end, at a second end, and on a side wall of the housing, respectively, with a vacuum chamber being formed in the housing and communicating with the intake port, the housing being configured such that at least two parts, including a main part provided with the intake port, and at least one adjacent part, are linearly arranged, wherein between the main part and the at least one adjacent part, a plurality of stopping members is provided along contact surfaces, whereby the main part is rotated relative to the at least one adjacent part, and accordingly a direction of the intake port is changed;

an ejector part including a cylindrical ejector main body mounted inside the housing, the ejector main body including: an inlet provided at a first end thereof and communicating with the inlet port; an outlet provided at a second end thereof and communicating with the exhaust port; and a through-hole provided on a side wall thereof and communicating with the intake port via the vacuum chamber;

means for providing adhesion between the main part and the at least one adjacent part; and pressing means, as the means for providing adhesion, provided at least one of opposite sides of the housing so as to provide adhesion between the parts, wherein the pressing means is a snap ring fitted over an external circumference of an outer protruding portion of the ejector part, the outer protruding portion protruding to an end of the housing.

14. The vacuum pump of claim 13, wherein the stopping members have a correspondent structure of protrusion-groove or rotatable saw-tooth.

15. The vacuum pump of claim 13, wherein the housing further includes a vacuum-break port communicating with the vacuum chamber.

16. The vacuum pump of claim 13, wherein a first support body includes a supply line extending to the inlet port, with an end of the inlet of the ejector main body being inserted into the supply line; and a vacuum-break line extending from a vacuum-break port provided in the housing to the vacuum chamber.

17. The vacuum pump of claim 13, wherein a second support body includes an exhaust line extending to the exhaust port, with an end of the outlet of the ejector main body being inserted thereinto.

18. The vacuum pump of claim 13, wherein a first support body or the second support body is configured to be divided into an inner body directly supporting the ejector main body and a protruding portion, the inner body and the protruding portion being coupled with each other by using U-shaped clips provided on outer surfaces thereof.

19. The vacuum pump of claim 13, wherein the pressing means includes: a plate coming into contact with each of side surfaces of the housing; and a pressing ring pressing the plate and the parts to be closed to each other by being inserted into an end of the ejector part or into the protruding portion having passed through a mount hole of the plate.

20. The vacuum pump of claim 19, wherein the plate is a bracket for locking the vacuum pump.

* * * * *